US005730892A

United States Patent [19]

Niwa et al.

[11] Patent Number: 5,730,892

[45] Date of Patent: Mar. 24, 1998

[54] RECYCLED SLIDE GATE PLATE

[75] Inventors: Shigeki Niwa, Toyoake; Etsuhiro Hasebe, Kariya; Kazuo Itoh, Chiryu; Toshihiro Indoh, Nagoya; Kohji Saitoh; Tamotsu Wakita, both of Kariya; Masahiko Uchita, Ibaraki-ken; Hiroshi Hikima, Chiba-ken, all of Japan

[73] Assignee: Toshiba Ceramics Co., Ltd., Tokyo, Japan

[21] Appl. No.: 773,038

[22] Filed: Dec. 24, 1996

Related U.S. Application Data

[63] Continuation of Ser. No. 518,900, Aug. 24, 1995, abandoned.

[30] Foreign Application Priority Data

Aug. 25, 1994 [JP] Japan ..... 6-201062

[51] Int. Cl.[6] ..... B22D 41/28

[52] U.S. Cl. ..... 222/590; 222/600; 266/DIG. 1

[58] Field of Search ..... 266/236, DIG. 1, 266/44; 222/600, 590

[56] References Cited

U.S. PATENT DOCUMENTS

| | | |
|---|---|---|
| 4,445,262 | 5/1984 | Cappelli . |
| 4,497,473 | 2/1985 | Robyn et al. . |
| 4,801,055 | 1/1989 | Muschner . |
| 4,951,929 | 8/1990 | Schwartz et al. . |

FOREIGN PATENT DOCUMENTS

| | | |
|---|---|---|
| 51-54108 | 10/1974 | Japan . |
| 59-19789 | 5/1984 | Japan . |
| 60-38660 | 3/1985 | Japan . |
| 61-41456 | 3/1986 | Japan . |
| 63-10063 | 1/1988 | Japan . |
| 64-15270 | 1/1989 | Japan . |
| 1-284473 | 11/1989 | Japan . |
| 2-38159 | 3/1990 | Japan . |
| 5-42349 | 2/1993 | Japan . |
| 405200531 | 8/1993 | Japan ..... 222/600 |

*Primary Examiner*—Scott Kastler
*Attorney, Agent, or Firm*—Pennie & Edmonds LLP

[57] ABSTRACT

The present invention provides a recycle slide gate plate, said slide gate plate being connected to a lower portion of a molten metal container and used for sliding a plate to control a flow of molten metal drained from the molten metal container, comprising an upper plate and/or a lower plate obtained by polishing a sliding surface of a slide gate plate used at least one time, at a predetermined smoothness tolerance, a tubular ring fixed to a through hole obtained by cutting out a molten metal outlet portion of the upper plate and/or the lower plate having a projecting portion on a side opposite to a sliding surface of the upper plate and/or the lower plate, said projecting portion having a total height of a sum of a height dimension substantially equal to a height of a projecting portion of a new plate before use and a thickness dimension to be reduced by polishing out the sliding surface, the projecting portion being provided with a molten metal outlet hole formed inside the projecting portion, and a cushion plate fixed to a flat surface in a side opposite to the sliding surface of the upper plate and/or the lower plate, having a thickness necessary for making a thickness dimension of a flat surface reduced by polishing the upper plate and/or the lower plate be substantially equal to a thickness of the flat surface before polishing.

4 Claims, 5 Drawing Sheets

RECYCLED SLIDE GATE PLATE

This is a continuation of application Ser. No. 08/518,900, filed Aug. 24, 1995, now abandoned.

BACKGROUND OF THE INVENTION

1. Field of the Invention

The present invention relates to recycle of a slide gate plate attached to a lower portion of a molten metal container and used for controlling a flow amount of molten metal drained from a molten metal container. More particularly, the present invention relates to a recycle slide gate plate which can be recycled and reused by recycling a slide gate plate put into use at least once.

2. Description of the Related Art

FIG. 8 shows an example of a conventional slide gate plate attached to a lower portion of a molten metal container and used for controlling the flow amount of molten metal in the container.

FIG. 8 shows a slide gate plate 10 adopting a twin-plate method. In FIG. 8, a reference 11 denotes an upper plate, and a lower plate 12 is provided such that the plate 12 can be slid with respect to the upper plate. A lower nozzle 13 is fixed on the lower side of the lower plate 12.

The upper and lower plates 11 and 12 are in tight contact with each other on their sliding surfaces to integrally form a slide gate plate 10, and is fixed on the lower portion of the molten metal container not shown in the figure.

In the slide gate plate 10, a hydraulic device not shown horizontally moves the lower plate 12, so that a nozzle hole 14 of the upper plate 11 and another nozzle hole 15 of the lower plate 12 are aligned with each other thereby to drain molten metal contained in the molten metal container not shown. In addition, the nozzle holes 14 and 15 of the upper and lower plates 11 and 12 may be offset from each other to stop draining the molten metal. These holes are thus used to control the flow amount of molten metal.

Further, FIG. 9 shows a slide gate plate 20 of another conventional slide gate plate 20. This slide gate plate 20 uses a middle plate 23 inserted between an upper plate 21 and a lower plate 22, as shown in FIG. 9.

In the slide gate plate 20 adopting a triple plate method, the upper and lower plates 21 and 22 are fixed while only the middle plate 23 can be horizontally slid via a drive shaft. Therefore, a nozzle hole 24 in the middle plate 23 is aligned with nozzle holes 25 and 26 respectively formed in the upper and lower plate 21 and 22 to drain molten metal from a molten metal container not shown in the figure. The nozzle hole 24 of the middle plate 23 may be offset from the nozzle holes 25 and 26 of the upper and lower plates 21 and 22, thereby to stop draining molten metal from the molten metal container not shown or to control the flow amount of the material.

In these slide plates, the vicinity of the nozzle holes of the upper or lower plate is severely damaged by the flow of molten metal during use, and therefore, the damaged plate must be replaced in an early timing.

However, replacement of slide gate plates requires much labor so that the manufacturing yield is thereby lowered. Also, replacement of expensive slide gate plates made of refractory material results in increases in casting costs. Dumping treatments of slide gate plates once used require much labor and leads to creation of industrial wastes.

In view of this circumstances, developments have been made as to a method of repairing and recycling a slide gate plate when the vicinity of the nozzle hole in a slide gate plate is damaged, and this has already been proposed.

For example, a used slide gate plate can be recycled in such a manner in which the portion in the vicinity of a nozzle hole in an upper or lower plate of a slide gate plate which is seriously damaged is removed by cutting out this portion in a tubular shape having a diameter larger than the diameter of the nozzle hole by means of bowling processing, inserting a new tubular straight ring in the cut out portion, and by polishing the sliding surface of the plate to attain the same smoothness as a new slide gate plate.

However, when a slide gate plate recycled by using a straight ring as stated above is used, and in particular when a lower plate is reused in this manner, the tubular straight ring attached to the nozzle hole may be damaged and put off during actual operation. Therefore, the present inventors developed and further improved the recycle method using a tubular straight ring, and proposed an improved recycle method as described in Japanese Patent Application KOKAI Publication No. 5-200531.

In this method, to recycle the nozzle hole portion of the slide gate plate, the portion including an outlet hole for molten metal is cut out to form a through-hole having a diameter larger than the outlet hole, and a tubular ring provided with a nozzle hole in its inner side and a ring-like jaw (projecting) portion in its outer periphery is inserted in the through-hole and is fixed thereto by mortar or the like.

According to this method, since a tubular ring having a projection portion is inserted in the portion in the plate thus cut out and fixed thereto by mortar, there is no problem in that the contact area is small and the cylinder member is inclined to be put off. Further, according to this method, a large portion including the periphery of the nozzle hole where damages are most serious is cut out, and a thick tubular ring is inserted therein. Therefore, it is possible to avoid damages with use of the gate plate thus recycled, so that a more excellent recycled slide gate plate can be obtained in comparison with a thin straight ring.

However, a slide gate plate recycled in this method lowers the possibility that an inserted tubular ring may be put off during operation, while there is a certain limitation to polishing of plates to be carried out for recycling and it is impossible to recycle a plate whose sliding surface is seriously damaged or to recycle a recycled plate.

Specifically, if polishing is performed to a thickness to remove a deep damage in a sliding surface or if the sliding surface of a plate once recycled is polished again to further recycle the plate for a second time, the plate may be thinner than a predetermined thickness necessary for a plate, and a pressure pressing the upper and lower plates of the slide gate plate device against each other and applied by a spring or the like may become insufficient to attain a predetermined surface pressure on the sliding surfaces.

If the surface pressure on the upper and lower plates is thus insufficient, there is a possibility that molten metal leaks from between these plates and leads to a serious accident.

Further, in case of a large plate, a used plate often includes a large camber or deformation, and it is therefore difficult in many cases to carry out polishing processing on the entire surface within the range of tolerances even in the recycle processing for the first time, resulting in that the recycling rate is greatly lowered. Particularly, in case of a plate having a length of 500 mm or more, one plate can substantially be recycled only for one time at most, and cannot be recycled for two or more times.

SUMMARY OF THE INVENTION

The present invention has an object of realizing a recycle slide gate plate which achieves a high recycle rate and can be recycled repeatedly, whereby a surface pressure on sliding surfaces is not lowered even when a sliding surface of an upper plate and/or a lower plate is sufficiently polished.

According to the present invention, there is provided a recycle slide gate plate, said slide gate plate being of a type connected to a lower portion of a molten metal container and used for sliding a plate to control a flow amount of molten metal drained from the molten metal container, comprising: an upper plate and/or a lower plate obtained by polishing one of front or back surfaces, which is to be a sliding surface after recycle, of a slide gate plate used at least one time, at a predetermined smoothness tolerance; a tubular ring fixed to a through hole obtained by cutting out a molten metal outlet portion of the upper plate and/or the lower plate and provided with a projecting portion on a side opposite to the polished sliding surface of the upper plate and/or the lower plate, said projecting portion having a total height dimension of a height dimension substantially equal to a height of a projecting portion projecting from a back side of a new plate before use and a thickness dimension reduced by the polishing so as to form the sliding surface, and said projecting portion being provided with a molten metal outlet hole formed inside the projecting portion; and a cushion plate fixed to a flat surface in a side opposite to the sliding surface of the upper plate and/or the lower plate, and having a thickness defined by adding a thickness dimension of a cushion plate fixed to the same flat surface of a new plate before the polishing, to a thickness dimension of the flat surface of the upper plate and/or lower plate, reduced by polishing the upper plate and/or lower plate.

The recycle slide gate plate according to the present invention may be consisting of an upper plate, a lower plate, and a sliding plate inserted between the upper and lower plates.

Further, the recycle slide gate plate according to the present invention may use an upper plate and/or a lower plate which have been used for two or more times.

Further, in the recycle slide gate plate according to the present invention, a tubular ring may be a ring having a ring-like jaw projecting portion.

Further, in the recycle slide gate plate according to the present invention, the ring-like projecting portion may be a gas-permeable ring.

Further, in the recycle slide gate plate according to the present invention, the cushion plate may be made of a metal plate, a ceramics plate, or a combination of metal and ceramics plates.

In the recycle slide gate plate according to the present invention, the cushion plate includes a portion of the thickness increased by implanting ceramics.

Note that the projecting portion projecting from the cushion plate has a shape and a size substantially equal to a projecting portion of a new plate which has not yet been used.

According to the present invention, the slide gate plate can be recycled and used for two or more time, e.g., three or four times, in comparison with a conventional slide gate plate which cannot be recycled or can be recycled only for one time at most. It is therefore possible to greatly reduce costs for slide gate plates.

In addition, according to the present invention, the surface pressure on the sliding surface of the recycle slide gate plate is not changed, but can be maintained at a proper surface pressure which will prevent leakage of molten metal. As a result, according to the present invention, it is possible to provide a recycle slide gate plate which achieves a high reliability.

Further, according to the present invention, since a slide gate plate can be repeatedly recycled, it is possible to contribute to decreases in the number of used slide gate plates treated as industrial waste.

BRIEF DESCRIPTION OF THE DRAWINGS

FIG. 2A is a plan view of the upper plate. FIG. 2B is a cross-section cut along a line 2B—2B of FIG. 2A. FIG. 2C is a perspective view of a tubular ring.

FIG. 3A is a cross-section of a used upper plate placed up-side-down, viewed from its front side. FIG. 3B is a cross-section of the upper plate of FIG. 3A in which a through-hole is cut at a molten metal outlet portion, viewed from its front side. FIG. 3C is a cross-section of the plate in which a tubular ring is inserted into the through-hole thus cut out from its upper side, viewed from its front side. FIG. 3D is a cross-section of the plate wherein the sliding surface of the plate provided with the tubular ring is polished. FIG. 3E is a cross-section of the plate placed up-side-down to which polishing of the sliding surface has been completed, viewed from its front side.

DETAILED DESCRIPTION OF THE PREFERRED EMBODIMENTS

Figure 1:
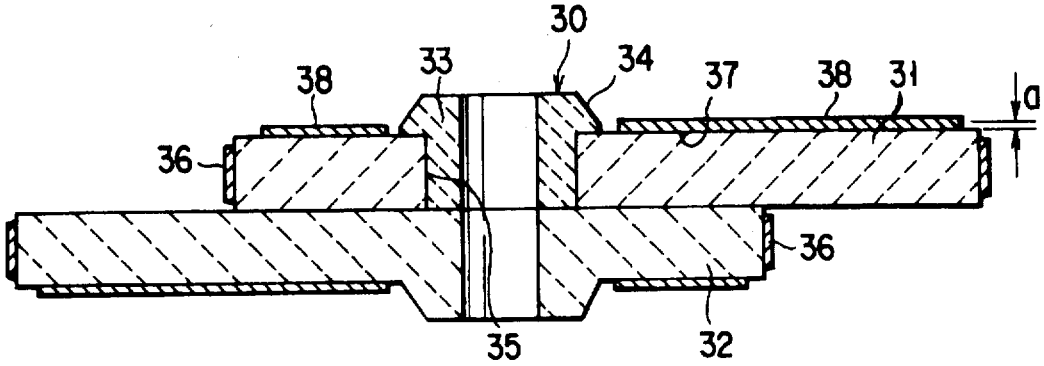
FIG. 1 is a cross-section showing a recycle slide gate plate according to an embodiment of the present invention, viewed from its front side.

FIG. 1 is a cross-section showing a slide gate plate 30 according to a first embodiment of the present invention viewed from its front side. In FIG. 1, references 31 and 32 respectively denote upper and lower plates. The material forming these upper and lower plates are refractory (ceramics). This recycle slide gate plate 30 is obtained by recycling an upper plate of a slide gate plate once used.

Figure 2A:
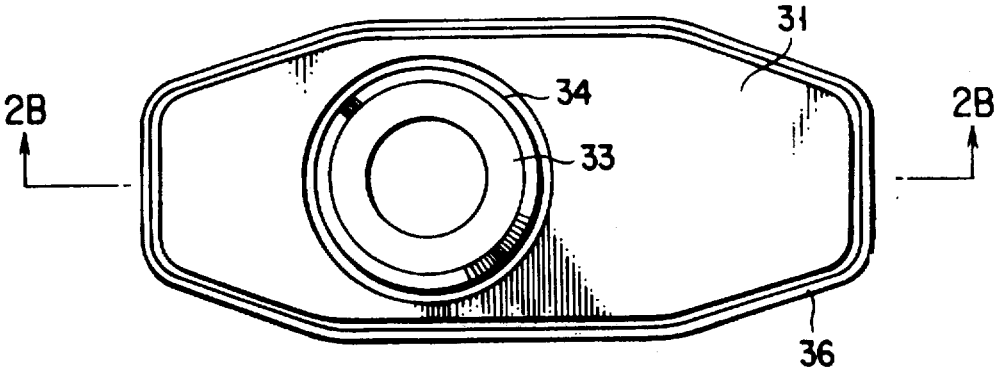
FIGS. 2A, 2B, and 2C show an upper plate of the recycle slide gate plate according to an embodiment of the present invention and components thereof.
Figure 2B:
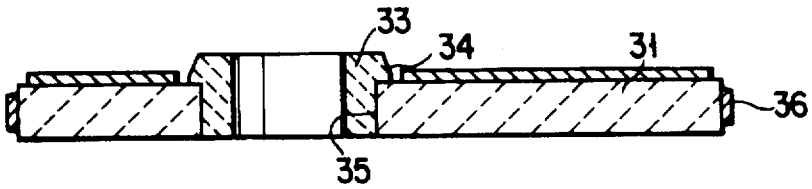
Figure 2C:
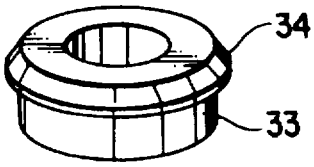

A plan view of a recycled upper plate 31 is shown in FIG. 2A, with its size slightly changed. A cross-section cut along line 2B—2B of FIG. 2A is shown as FIG. 2B. In FIGS. 2A and 2B, reference 33 denotes a tubular ring. A perspective view of the tubular ring 33 is shown as FIG. 2C. In FIG. 2C, reference 34 denotes a ring-like jaw (projecting) portion provided on the outer circumference at an upper end of the tubular ring. In FIG. 2B, reference 35 denotes a through-hole cut out including an outlet hole for molten metal so as to have a size slightly larger than the outlet hole. Reference 36 denotes a hoop tightened to an outer periphery of a plate.

Recycling of an upper plate is performed via steps shown in FIGS. 3A to D.

Figure 3A:
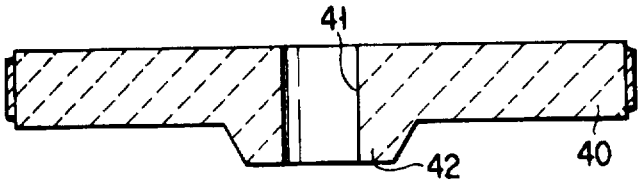
FIGS. 3A, 3B, 3C, 3D and 3E show an example of steps for manufacturing a recycle slide gate plate according to an embodiment of the present invention.

FIG. 3A shows an upper plate 40 of a slide gate plate once used, illustrated up-side-down. This plate is damaged at its molten metal outlet hole 41 and sliding surface. This plate is recycled in the following manner.

Figure 3B:
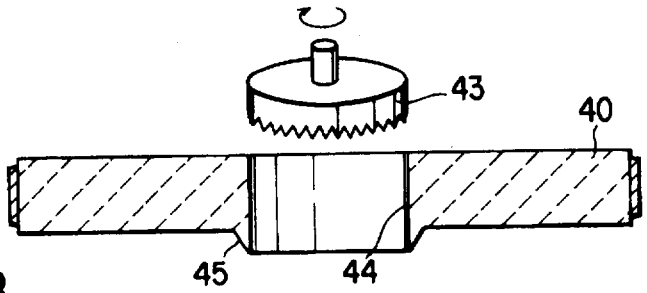

At first, a portion of a projecting portion 42 in a molten metal outlet portion is cut out from the plate 40 with a drill 43, thereby to form a through-hole 44 as shown in FIG. 3B. This projecting portion 42 is cut out to have a diameter slightly smaller than the outer diameter of the projecting portion 42 such that an end portion 45 of a projecting portion 42 slightly remains.

Figure 3C:
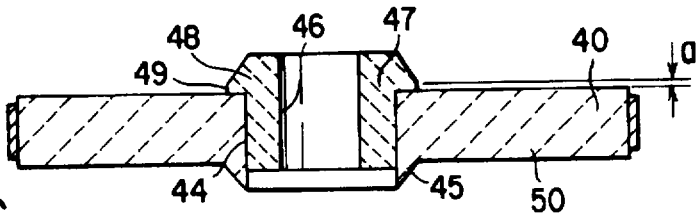

A tubular ring 47 having a molten metal outlet hole 46 formed in its center portion from the upper side as shown in FIG. 3C is inserted into the upper plate 40 which has a through-hole 44 formed in its inner side, as shown in FIG. 3B, from the upper surface of the plate. This tubular ring 47 has a length which allows formation of a projecting portion 48 projecting in the upper side of the upper plate 40, and a height greater than the height of a projecting portion of a new upper plate before use by a slight dimension a, i.e., by the dimension a which is equivalent to a polishing margin shown in FIG. 3D. A ring-like projecting portion 49 having a substantially triangular cross-section whose corners are rounded is integrally formed on the outer periphery of the projecting portion 48, and the ring 49 is engaged on the upper surface of the upper plate 40 as shown in the figure.

The ring-like projecting portion 49 integrally formed on the upper side of the tubular ring 47 should preferably be arranged to have a size (i.e., an outer diameter) substantially equal to the outer diameter of a projecting portion provided for a new upper plate before recycle.

In view of the above, a through-hole 44 must be cut out such that an end portion 45 of a projecting portion of a plate before use slightly remains as shown in FIG. 3C, and the tubular ring 47 provided for the ring-like projecting portion 49 is inserted in the through-hole 44.

In FIG. 3C, the projecting portion 48 of the tubular ring 47 is inserted so as to be positioned in the side of the sliding surface of the plate before recycle. The tubular ring 47 may otherwise be inserted from the lower side of the upper plate 40 to be positioned in the side opposite to the sliding surface. In this case, however, the end portion 45 of the projecting portion of the upper plate 40 shown in FIG. 3B must be previously cut and removed to smoothen this surface before inserting the tubular ring 47.

Figure 3D:
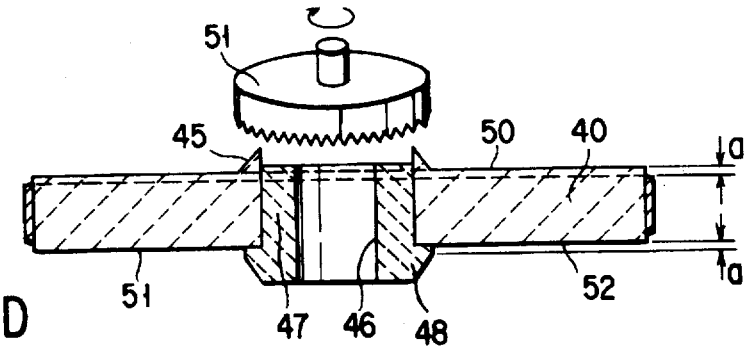

In the next, the upper plate 40 is placed upside-down as shown in FIG. 3D, and the surface 50 to be formed as a new sliding surface is sufficiently polished and smoothed with a polishing tool 51. In FIG. 3D, the polishing margin of the new sliding surface 50 of the upper plate 40 is enlarged and indicated by broken lines, and reference a denotes the thickness dimension of the margin.

After the surface 50 to be formed as a new sliding surface of the plate is polished by the thickness dimension a, the thickness of the upper plate 40 is naturally reduced by this dimension. However, the upper end of the projecting portion 48 of the tubular ring 47 is previously arranged to have a height including the dimension a equivalent to the thickness dimension a, so that the height of the tubular ring 47 of the plate 40 is reduced not to be smaller than but to be substantially equal to the height of a new plate even after polishing. However, the thickness of the portion of the flat surface 52 of the upper plate 40 other than the projecting portion is reduced by the thickness dimension a due to polishing performed on the opposite sliding surface.

Figure 3E:
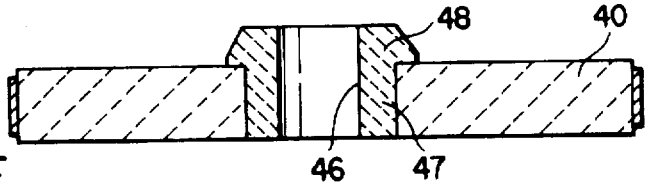

The upper plate 40 thus recycled is reversed up-side-down as shown in FIG. 3E.

The upper plate recycled as above is combined with a lower plate as shown in FIG. 1.

Specifically, a cushion plate 38 or the like is fixed on the flat surface 37 of the recycled upper plate 31 as a non-sliding surface by means of an adhesion or the like, and the same lower plate as used before recycling is used without changes or a new lower plate is used. These upper and lower plates are combined to form a slide gate plate 30.

The cushion plate 38 used here needs to be arranged so as to have a thickness greater by the dimension a of the polishing margin than the thickness of a normal cushion plate for a new upper plate, in order to compensate for the thickness by a corresponding thickness dimension, since the sliding surface of the upper plate 31 is polished for recycling and the thickness of the portion of the flat surface of the plate is reduced to be thinner by the dimension a than the thickness of an upper plate of a new product, as shown in FIG. 3D.

In this manner, the thickness dimension obtained by adding the thickness of the recycled upper plate to the thickness of a cushion plate fixed thereon the flat surface of this upper plate can be arranged to be substantially equal to the thickness dimension obtained by adding the thickness of an upper plate of a new slide gate plate to the thickness of a new cushion plate fixed on the flat surface of this upper plate.

Figure 4A:
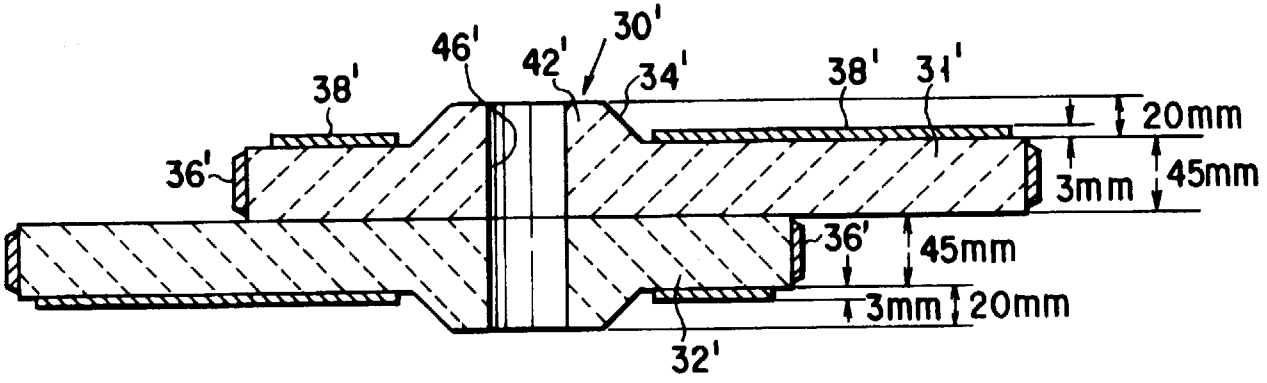
FIG. 4A shows an example of each dimension, i.e., thicknesses of an upper plate and a lower plate of a new slide gate plate before recycle, thicknesses of cushion plates fixed on flat surfaces of an upper plate and a lower plate, and heights of jaw projecting portions of an upper plate and a lower plate.
Figure 4B:
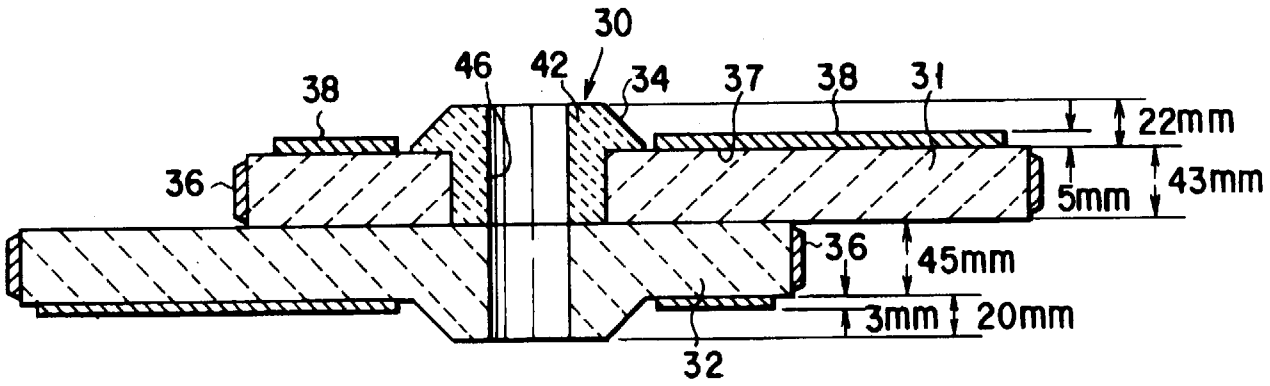
FIG. 4B shows an example of each dimension, i.e., thickness of the same upper plate and lower plate as described above after the slide gate plate of FIG. 4A is used and recycled, thicknesses of cushion plates fixed on flat surfaces of the upper plate and lower plate, and heights of jaw projecting portions of the upper plate and lower plate.

FIGS. 4A and 4B shows differences in dimensions of plates and cushions between a slide gate plate before recycling and a slide gate plate subjected to recycling, by indicating specific numerical values.

FIG. 4A shows a slide gate plate before recycling. This new slide gate plate is subjected to use for a predetermined period and is recycled to be a recycled slide gate plate shown in FIG. 4B.

As shown in FIG. 4A, an upper plate 31' of a new slide gate plate before recycling has a thickness of 45 mm. The cushion plate thereof has a thickness of 3 mm, and the dimension from the upper surface of this cushion plate to the upper end of a projecting portion 41' is 20 mm.

However, the thickness of this slide gate plate is reduced to 43 mm since the sliding surface of the upper plate is polished when this slide gate plate is recycled after use. Specifically, the sliding surface of the upper plate is polished by 2 mm. Therefore, in a recycled gate plate, the thickness of a cushion plate fixed on the flat surface in the side opposite to the sliding surface of the upper plate is set to 5 mm which is decided by adding a dimension of 2 mm equivalent to the reduction in thickness of the upper plate, to the thickness of a cushion plate used for an upper plate of a new slide gate plate, so that the sum of the thicknesses of the upper plate and the cushion plate is not changed from the sum of them before recycling.

Material of the cushion plate used here is constituted by a metal plate, a ceramics plate, or a combination of a metal and ceramics plate bonded on each other.

When the slide gate plate 30 recycled in the manner as explained above is mounted on a molten metal container not shown, it is possible to make the pressure from the spring not shown in contact with the cushion plate on the plate 31 to operate in the same manner as in the slide gate plate before recycling. Therefore, if the recycle plate of the present invention is used, the surface pressure between the plates is not reduced and there is not a possibility that molten metal leaks from between the sliding plates.

In FIGS. 1 and 4, although only the upper plate is recycled, only the lower plate may be recycled or the upper and lower plates may simultaneously or individually be recycled in the same manner as explained above. Further, it is possible to recycle either the upper or lower plate and to use the recycled plate as a recycled upper plate, in combination with a new lower plate.

Further, after a plate once recycled is used, the recycled plate may further be recycled and used not only once more, but also for three, four and more times, as will be explained in the following use examples. This has not been considered at all on the basis of prior art techniques. In this case, the method of recycling a plate is substantially equal to the method as explained above.

Figure 5:
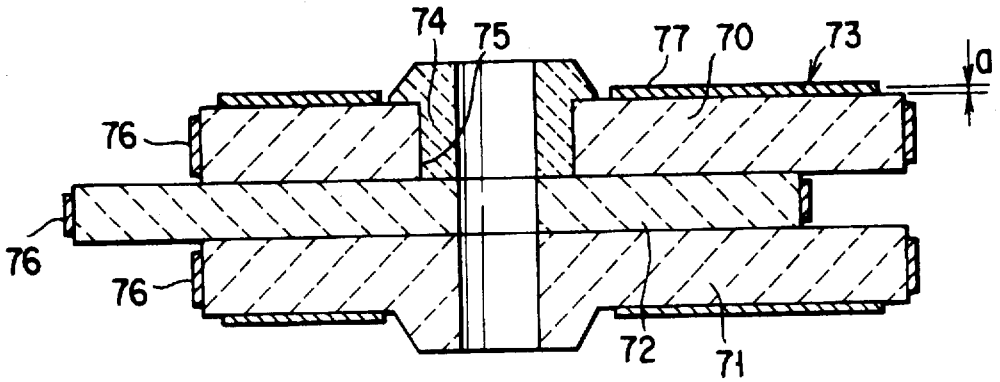
FIG. 5 is a cross-section showing a recycle slide gate plate in which a middle plate is inserted between an upper plate and a lower plate, according to another embodiment of the present invention, viewed from its front side.

FIG. 5 shows a recycled slide gate plate 73 which uses a sliding middle plate 72 inserted between an upper plate 70 and a lower plate 71 wherein a recycled upper plate is used as the upper plate 70. In this case, recycling of the upper plate can be achieved in the same manner as in the method of recycling a slide gate plate consisting of two plates, i.e., the upper and lower plates, described with reference to FIGS. 1 and 3.

Meanwhile, in the slide gate plate 73 shown in FIG. 5, only the upper plate 70 is a recycled plate. However, the lower plate 71 may be a recycled plate.

Further, the upper plate and the lower plate are not limited to those which have been subjected to recycling for one time, but may be those which have been repeatedly subjected to recycling. Recycling to be repeatedly performed is carried out in the same manner as described above.

In FIG. 5, references 74, 75, 76, and 77 respectively denote a tubular ring, a through-hole, a hoop, and a cushion plate.

Figure 6:
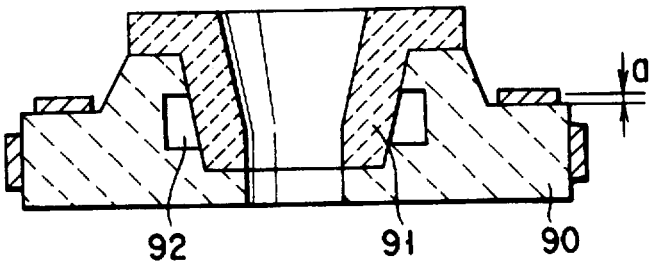
FIG. 6 is a cross-section of an upper plate of a conventional slide gate plate viewed from its front side, in which a gas-permeable refractory member is engaged around a molten metal outlet hole.

FIG. 6 shows a cross-section of an upper plate of a slide gate plate engaged with a conventional gas-permeable fire-resistance member, viewed from its front side. In FIG. 6, references 90 and 91 respectively denote an upper plate and a gas-permeable refractory member engaged with the upper plate. This gas-permeable refractory member 91 is, for example, of fine refractory (ceramics) substance and is provided with small pores not shown each having a diameter of 0.1 to 1.0 mm. This member is provided at a side portion of a molten metal outlet hole of the upper plate 90, and is connected with a gas introduce tube not shown. An inert gas supplied therefrom through a gas pressure equalizer strip 92 is supplied into molten metal through the small bores.

Figure 7A:
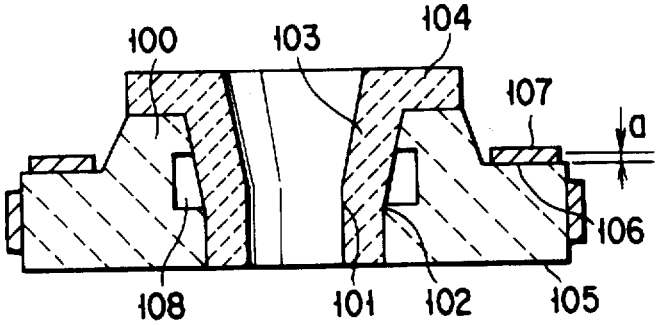
FIG. 7A is a cross-section of an upper plate of a recycle slide gate plate according to an embodiment of the present invention, viewed from its front side, in which a gas-permeable refractory member is engaged around a molten metal outlet hole.

The plate shown in FIG. 7A is an upper plate 100 obtained by recycling the upper plate provided with the gas-permeable refractory member shown in FIG. 6. This upper plate 100 is substantially recycled in the same procedures as explained above.

Specifically, the gas-permeable refractory member used is removed and the molten metal outlet hole 101 of the upper plate 100 is cut out to form a through-hole 102, in which a new gas-permeable refractory member 103 is inserted. The new gas-permeable refractory member 103 has a projecting portion 104, and the height of this projecting portion 104 must be determined by adding a slight dimension height of a margin to be reduced by polishing to the height of a projecting portion of a new plate, so that the plate substantially has the same height as a new plate rearranged of a height after the sliding surface 105 of the plate 100 is polished. Thereafter, the sliding surface 105 of the plate 100 is polished and smoothed at a thickness dimension not shown in the figure. Further, a cushion plate 107 having a thickness obtained by adding a thickness dimension a substantially equivalent to the thickness polished out to the dimension of a cushion plate of a normal new plate is fixed on the flat surface in the side opposite to the sliding surface of the plate, in order that the thickness of the plate 100 at the flat surface 106 is substantially equal to the thickness before polishing.

Figure 7B:
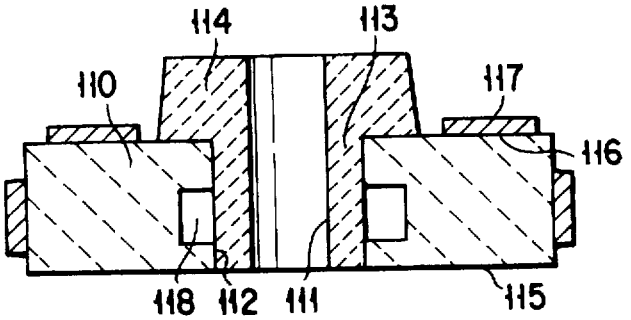
FIG. 7B is a cross-section of an upper plate of a recycle slide gate plate according to an embodiment of the present invention suitable for a plurality of recycle uses, viewed from its front side, in which a gas-permeable refractory member is engaged around a molten metal outlet hole.
Figure 8:
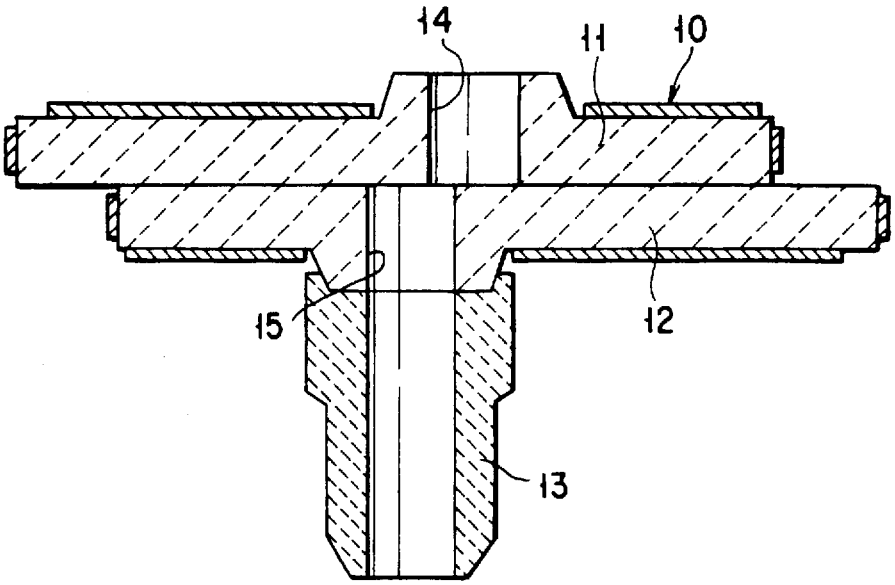
FIG. 8 is a side cross-section of a conventional slide gate plate viewed from its front side.
Figure 9:
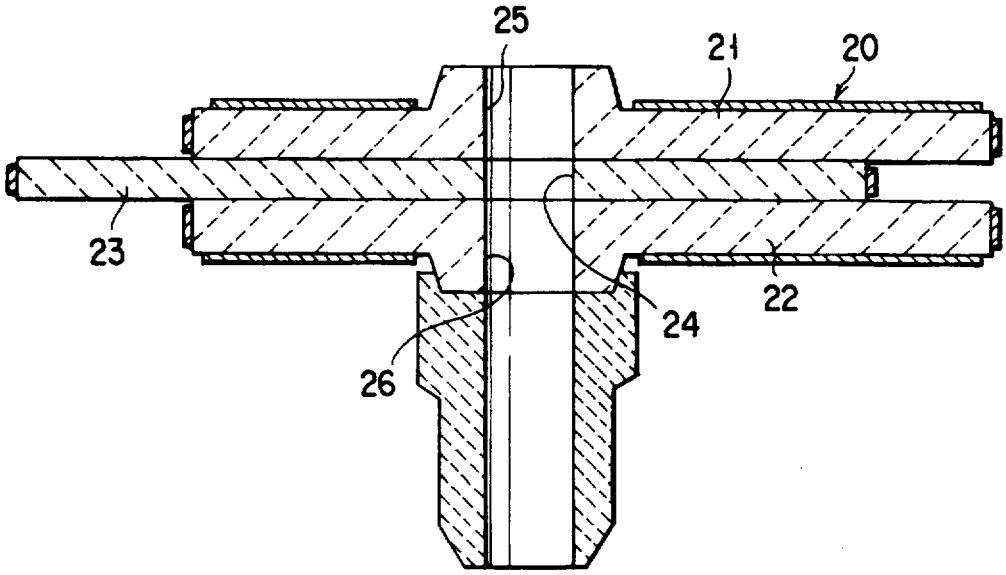
FIG. 9 is a side cross-section of another conventional slide gate plate viewed from its front side.

Note that the gas-permeable refractory member shown in FIG. 7A is not suitable for recycle use for a plurality of times since the diameter of the tubular portion of this member varies. However, the shape shown in FIG. 7B has a molten metal outlet hole of the same diameter, and can therefore be recycled for a plurality of times. In FIG. 7B, references 113, 114, 115, 116, and 117 respectively denote a new gas-permeable refractory member, a projecting portion, a sliding surface of a plate 110, a flat surface of the plate 110, and a cushion plate.

Next explanation will be made to examples of use of a recycle slide gate plate according to the present invention.

EXAMPLE 1

A used product of a slide gate plate for use in a tundish, which has a total length 350 mm and consisting of an upper plate and a lower plate, was used to prepare a recycle slide gate plate according to an embodiment of the present invention (referred to as an example of present invention) and a conventional recycle slide gate plate (referred to as a comparative example).

The slide gate plate according to the embodiment was prepared in the following manner.

Specifically, a projecting portion was cut out and removed from an upper plate once used as shown in FIG. 3A, and this plate was placed upside-down as shown in FIG. 3B. As shown in FIG. 3C, a tubular ring having a new molten metal outlet hole formed in its center portion was inserted in the plate from the upper side such that the tubular ring slightly projects from the opposite side of the plate. This plate was turned upside-down again and the sliding surface of the plate was sufficiently polished. The plate was turned up-side-down once again to obtain the plate shown in FIG. 3E.

Further, since the thickness of the flat surface of this plate was reduced by polishing of the sliding surface in the recycle processing, a cushion plate having a thickness dimension equal to the sum of a thickness of a cushion plate used for a new plate and the dimension of the thickness reduced by polishing was fixed onto the flat surface of the plate, so that the thickness of the flat surface was equal to the thickness of the flat surface of a new plate. The plate thus recycled was used as a lower plate and was combined with a new upper plate to form a recycle slide gate plate. Any of cushion plates used for a new plates and a recycle plate were made of a combination of a ceramics plate and a metal plate.

As conventional examples, two kinds of comparative examples were prepared. In one example (referred to as a straight-ring method), a projecting portion is cut out from a lower plate of a slide gate plate once used, and a tubular straight ring is inserted in the portion thus cut out. The sliding surface of the plate is polished and a cushion plate was used without changes. In the other example (referred to as a projecting portion ring method), a projecting portion was cut out from a lower plate of a slide gate plate once used, like in the above example, and a ring-like projecting portion having a projecting portion whose shape was substantially equal to the ring shown in FIG. 2A was inserted in the portion cut out. The sliding surface was polished, and a cushion plate was used without changes. The plates thus recycled were used as lower plates and were combined with new upper plates to for conventional recycle slide gate plates.

These recycle slide gate plates were individually attached to a tundish and repeatedly used for normal casting of low carbon steel. In each of tests, a used upper plate was recycled and used as a lower plate, and the recycled lower plate was combined with a new upper plate for every test. Results of these tests are shown in Table 1 below as an example 1 of the present invention and comparative examples 1 and 2.

A molten metal container for supplying molten metal for a tundish was of 160 ton size.

TABLE 1

| | PRESENT | PRIOR ART EXAMPLE | |
|---|---|---|---|
| | INVENTION EMBODIMENT 1 PROJECTING PORTION RING METHOD | COMPARATIVE EXAMPLE 1 STRAIGHT RING METHOD | COMPARATIVE EXAMPLE 2 PROJECTING PORTION RING METHOD |
| NEW PRODUCT | | | |
| NUMBER OF USED TIMES (ch) | 10 | 10 | 10 |
| FLAT PORTION THICKNESS (mm) | 35 | 35 | 35 |
| PROJECTING PORTION THICKNESS (mm) | 20 | 20 | 20 |
| CUSHION PLATE THICKNESS (mm) | 3 | 3 | 3 |
| *1 RECYCLE RATE (%) | 85 | 25 | 40 |
| FIRST RECYCLE | | | |
| NUMBER OF USED TIMES (ch) | 10 | 4 | 10 |
| FLAT PORTION THICKNESS (mm) | 33 | 34.6 | 34.6 |
| *2 PROJECTING PORTION THICKNESS (mm) | 22 | 20 | 20 |
| CUSHION PLATE THICKNESS (mm) | 5 | 3 | 3 |
| RECYCLE RATE (%) | 71 | SECOND RECYCLE IMPOSSIBLE (NO POLISHING MARGIN) | SECOND RECYCLE IMPOSSIBLE (NO POLISHING MARGIN) |
| SECOND RECYCLE | | | |
| NUMBER OF USED TIMES (ch) | 9 | | |
| FLAT PORTION THICKNESS (mm) | 31 | | |
| PROJECTING PORTION THICKNESS (mm) | 24 | — | — |
| CUSHION PLATE THICKNESS (mm) | 7 | | |
| RECYCLE RATE (%) | 55 | | |
| THIRD RECYCLE | | | |
| NUMBER OF USED TIMES (ch) | 7 | | |
| FLAT PORTION THICKNESS (mm) | 29 | | |
| PROJECTING PORTION THICKNESS (mm) | 26 | — | — |
| CUSHION PLATE | 9 | | |

TABLE 1-continued

| | PRESENT | PRIOR ART EXAMPLE | |
|---|---|---|---|
| | INVENTION EMBODIMENT 1 PROJECTING PORTION RING METHOD | COMPARATIVE EXAMPLE 1 STRAIGHT RING METHOD | COMPARATIVE EXAMPLE 2 PROJECTING PORTION RING METHOD |
| THICKNESS (mm) | | | |
| RECYCLE RATE (%) | 38 | | |
| FOURTH RECYCLE | | | |
| NUMBER OF USED TIMES (ch) | 5 | | |
| FLAT PORTION THICKNESS (mm) | 26 | | |
| PROJECTING PORTION THICKNESS (mm) | 29 | — | — |
| CUSHION PLATE THICKNESS (mm) | 12 | | |
| RECYCLE RATE (%) | RECYCLE IMPOSSIBLE (SHORTAGE OF THICKNESS REST) | | |
| MAXIMUM NUBER OF USED TIMES (ch) | 41 | 14 | 20 |

*1 (RECYCLABLE PIECES/USED PIECES × 100
*2 INCLUDING MORTAR MARGIN BETWEEN FLAT AND PROJECTING PORTIONS
*3 FLAT PORTION TOLERANCE OF NEW PRODUCT IS 35 ± 0.5 mm

The item "number of use times (ch)" used in Table 1 means how many ladles of molten metal had been poured into a tundish before the slide gate plate attached to the tundish ceased to perform its function.

As shown in Table 1, the recycle slide gate plate according to the present invention could be recycled for total four times, wherein the thickness of a cushion plate was at first 3 mm when the slide gate late was used as a new product, and thereafter increased to, 5 mm, 7 mm, 9 mm, and to 12 mm. On the other hand, each of the recycle slide gate plates according to the comparative examples 1 and 2 could recycled for only one time, and could not be recycled any more.

EXAMPLE 2

With use of a used product of a lower plate of a slide gate plate attached to a lower portion of a molten metal container having a total length of 550 mm, a recycle slide gate and conventional recycle slide gate plates like in the above example 1 were prepared. Each of these slide gate plates was attached to a molten metal container of 230 ton size actually used, and was used for conventional casting of low carbon steel. Results of the test use were shown in Table 2 as an example 2 of the present invention and comparative examples 3 and 4.

TABLE 2

| | PRESENT | PRIOR ART EXAMPLE | |
|---|---|---|---|
| | INVENTION EMBODIMENT 2 PROJECTING PORTION RING METHOD | COMPARATIVE EXAMPLE 3 STRAIGHT RING METHOD | COMPARATIVE EXAMPLE 4 PROJECTING PORTION RING METHOD |
| NEW PRODUCT | | | |
| NUMBER OF USED TIMES (ch) | 8 | 8 | 8 |
| FLAT PORTION THICKNESS (mm) | 45 | 45 | 45 |
| PROJECTING PORTION THICKNESS (mm) | 20 | 20 | 20 |
| CUSHION PLATE THICKNESS (mm) | 3 | 3 | 3 |
| *1 RECYCLE RATE (%) | 75 | 3 | 8 |

TABLE 2-continued

| | PRESENT | PRIOR ART EXAMPLE | |
|---|---|---|---|
| | INVENTION EMBODIMENT 2 PROJECTING PORTION RING METHOD | COMPARATIVE EXAMPLE 3 STRAIGHT RING METHOD | COMPARATIVE EXAMPLE 4 PROJECTING PORTION RING METHOD |
| FIRST RECYCLE | | | |
| NUMBER OF USED TIMES (ch) | 7 | 3 | 7 |
| FLAT PORTION THICKNESS (mm) | 43 | 44.6 | 44.6 |
| *2 PROJECTING PORTION THICKNESS (mm) | 22 | 20 | 20 |
| CUSHION PLATE THICKNESS (mm) | 5 | 3 | 3 |
| RECYCLE RATE (%) | 63 | SECOND RECYCLE IMPOSSIBLE (NO POLISHING MARGIN) | SECOND RECYCLE IMPOSSIBLE (NO POLISHING MARGIN) |
| SECOND RECYCLE | | | |
| NUMBER OF USED TIMES (ch) | 7 | | |
| FLAT PORTION THICKNESS (mm) | 41 | | |
| PROJECTING PORTION THICKNESS (mm) | 24 | — | — |
| CUSHION PLATE THICKNESS (mm) | 7 | | |
| RECYCLE RATE (%) | 50 | | |
| THIRD RECYCLE | | | |
| NUMBER OF USED TIMES (ch) | 7 | | |
| FLAT PORTION THICKNESS (mm) | 39 | | |
| PROJECTING PORTION THICKNESS (mm) | 26 | — | — |
| CUSHION PLATE THICKNESS (mm) | 9 | | |
| RECYCLE RATE (%) | 35 | | |
| FOURTH RECYCLE | | | |
| NUMBER OF USED TIMES (ch) | 5 | | |
| FLAT PORTION THICKNESS (mm) | 36 | | |
| PROJECTING PORTION THICKNESS (mm) | 29 | — | — |
| CUSHION PLATE THICKNESS (mm) | 12 | | |
| RECYCLE RATE (%) | 8 | | |
| MAXIMUM NUBER OF USED TIMES (ch) | 34 | 11 | 15 |

*1 (RECYCLABLE PIECES/USED PIECES × 100
*2 INCLUDING MORTAR MARGIN BETWEEN FLAT AND PROJECTING PORTIONS
*3 FLAT PORTION TOLERANCE OF NEW PRODUCT IS 35 ± 0.5 mm

As shown in Table 2, in case of a long plate having a length of 550 mm, the slide gate plate according to the present invention could be recycled for total four times, wherein the thickness of a cushion plate was at first 3 mm when the slide gate plate was used as a new produce, and thereafter increased to 5 mm, 7 mm, 9 mm, and to 12 mm. On the other hand, each of the recycle slide gate plates according to the comparative examples 1 and 2 could recycled for only one time, and could not be recycled any more.

In addition, when another test was carried out to combine normal cushion material with plates implanted with ceramics (spinel) to thicknesses of 3 mm, 5 mm, and 7 mm in accordance with the number of recycled times. In this test, functional differences were not found in comparison with cushion plates having increased thicknesses, and such combinations could sufficiently be put into practical use.

What is claimed is:

1. A method of recycling a plate of a used multiple plate slide gate plate having a sliding surface, a projecting surface opposite said sliding surface having a projecting portion and a through-hole formed through said projecting portion having a damaged inner surface, said slide gate plate being used for controlling the volume of molten metal discharged from a molten metal container, comprising the steps of:

(a) cutting out a new through-hole having a larger diameter than said damaged through-hole diameter and in approximately the same location;

(b) fitting a tubular ring having a projecting portion, a flat portion and a molten metal outlet portion formed through the ring into said new through-hole of said plate, whereby said projecting portion of said tubular ring is protruding from said sliding surface of said plate to form a new projecting surface; and (c) polishing said projecting surface of said plate to form a new sliding surface.

2. The method of recycling a plate of a used multiple plate slide gate plate, according to claim 1, wherein the step of fitting a tubular ring comprises fitting a gas-permeable ring.

3. A method of recycling a used multiple plate slide gate plate comprising at least an upper plate and a lower plate used for controlling the volume of molten metal discharged from a molten metal container, each said plate comprising a sliding surface, a projecting surface opposite said sliding surface having a projecting portion and a through-hole formed through said projecting portion, said method comprising the steps of:

(a) cutting out a new through-hole in either or both of said plates in the event a plate has a damaged inner surface, said new through-hole having a diameter larger than said damaged through-hole diameter and being positioned in approximately the same location;

(b) fitting a tubular ring having a projecting portion, a flat portion and a molten metal outlet portion formed through the ring into each of said new through-holes of one or both of said plates whereby said projecting portion of said tubular ring is protruding from said sliding surface of said plate to form a new projecting surface;

(c) polishing said projecting surface of either one or both of said plates to form a new sliding surface;

(d) positioning a cushion overlay on said new projecting surface of one or both of said plates, each cushion overlay having a total thickness substantially equal to the sum of a thickness dimension of a cushion overlay used on a new slide gate plate and a dimension corresponding to the reduction in thickness of said plate achieved by polishing said plate; and (e) assembling said upper plate and said lower plate into a recycled multiple plate slide gate plate.

4. The method of recycling a used multiple plate slide gate plate, according to claim 3, wherein said cushion overlay is comprised of metal, ceramic, or a material composed of both metal and ceramic.

* * * * *